US011257419B2

(12) United States Patent
Hsiao

(10) Patent No.: US 11,257,419 B2
(45) Date of Patent: Feb. 22, 2022

(54) CURRENT DRIVING DIGITAL PIXEL APPARATUS FOR MICRO LIGHT EMITTING DEVICE ARRAY

(71) Applicant: Novatek Microelectronics Corp., Hsinchu (TW)

(72) Inventor: Sheng-Wen Hsiao, Changhua County (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

(21) Appl. No.: 16/503,651

(22) Filed: Jul. 5, 2019

(65) Prior Publication Data

US 2020/0090578 A1 Mar. 19, 2020

Related U.S. Application Data

(60) Provisional application No. 62/731,090, filed on Sep. 14, 2018.

(51) Int. Cl.
*G09G 3/32* (2016.01)
*G09G 3/20* (2006.01)

(52) U.S. Cl.
CPC ..... *G09G 3/32* (2013.01); *G09G 3/2003* (2013.01); *G09G 2330/021* (2013.01)

(58) Field of Classification Search
CPC ... G09G 3/32; G09G 3/2003; G09G 2330/021
See application file for complete search history.

(56) References Cited

U.S. PATENT DOCUMENTS

| | | | | |
|---|---|---|---|---|
| 7,956,831 | B2 | 6/2011 | Roush et al. | |
| 9,502,426 | B1 * | 11/2016 | Kuo | H01L 27/11206 |
| 10,395,589 | B1 * | 8/2019 | Vahid Far | G09G 3/3208 |
| 2008/0297452 | A1 * | 12/2008 | Roush | G09G 3/3233 345/82 |
| 2009/0243512 | A1 | 10/2009 | Nagumo | |
| 2017/0092196 | A1 * | 3/2017 | Gupta | G09G 3/3266 |
| 2019/0189234 | A1 * | 6/2019 | Chen | G09G 3/3677 |
| 2019/0347981 | A1 * | 11/2019 | Horowitz | G09G 3/346 |

FOREIGN PATENT DOCUMENTS

| | | |
|---|---|---|
| CN | 1355516 | 6/2002 |
| TW | 200917199 | 4/2009 |

OTHER PUBLICATIONS

"Office Action of Taiwan Counterpart Application", dated Aug. 28, 2020, p. 1-p. 12.

* cited by examiner

*Primary Examiner* — Stephen G Sherman
(74) *Attorney, Agent, or Firm* — JCIPRNET

(57) ABSTRACT

A current driving digital pixel apparatus including a power rail, a common rail, a micro light emitting device, and a current driver is provided. The power rail is configured to supply a source current. The micro light emitting device is electrically coupled to the common rail. The current driver includes a first switching device electrically coupled to the power rail and a current mirror device electrically coupled between the first switching device and the micro light emitting device. The current mirror device receives the source current from the power rail through the first switching device and supplies a current to the micro light emitting device. The first switching device is a low voltage device and the current mirror device is a medium voltage device.

15 Claims, 10 Drawing Sheets

DPb

DPa

CURRENT DRIVING DIGITAL PIXEL APPARATUS FOR MICRO LIGHT EMITTING DEVICE ARRAY

CROSS-REFERENCE TO RELATED APPLICATION

This application claims the priority benefit of U.S. provisional application Ser. No. 62/731,090, filed on Sep. 14, 2018. The entirety of the above-mentioned patent application is hereby incorporated by reference herein and made a part of this specification.

BACKGROUND

Technical Field

The disclosure relates to a current driving digital pixel apparatus, more specifically, to a current driving digital pixel apparatus for a micro light emitting device array.

Description of Related Art

The light emitting diode (micro-LED) array is generally driven by current drivers in one-to-one configuration. That is to say, each micro-LED in the array is driven by a current of the corresponding current driver. In the conventional configuration, the switching device is a medium voltage (MV) device. Therefore, the turn-on resistance is large, a large turn-on voltage level is needed, and dynamic current consumption is also large.

In addition, when fine pitch micro-LED is applied. The original one-to-one configuration becomes an obstacle to overcome when reducing pixel pitch. Further, the available area in the circuit is restricted, and flexibility in designing current drivers is also limited.

SUMMARY

The disclosure is directed to a current driving digital pixel apparatus for a micro light emitting device array, capable of reducing the dynamic power and the coupling back noise and achieving finer pitch micro light emitting device.

The disclosure provides a current driving digital pixel apparatus including a power rail, a common rail, a micro light emitting device, and a current driver is provided. The power rail is configured to supply a source current. The micro light emitting device is configured to be electrically coupled to the common rail. The current driver includes a first switching device configured to be electrically coupled to the power rail and a current mirror device configured to be electrically coupled between the first switching device and the micro light emitting device. The current mirror device is configured to receive the source current from the power rail through the first switching device and supplies a current to the micro light emitting device. The first switching device is a low voltage device and the current mirror device is a medium voltage device.

In one embodiment of the disclosure, the first switching device is a switching transistor, and the current mirror device is a current mirror transistor circuit.

In one embodiment of the disclosure, the first switching device is configured to turn on and turn off the source current received by the current mirror device.

In one embodiment of the disclosure, the micro light emitting device is a red, green, or blue micro-LED.

In one embodiment of the disclosure, an anode of the micro light emitting device is electrically connected to the current mirror device, and a cathode of the micro light emitting device is electrically connected to the common rail.

In one embodiment of the disclosure, the micro light emitting device and the current driver are located in a same area of a digital pixel cell.

In one embodiment of the disclosure, the micro light emitting device is located in an area of a digital pixel cell, and at least the first switching device of the current driver is located in a driver area outside of the area of the digital pixel cell.

In one embodiment of the disclosure, the first switching device and the current mirror device of the current driver are both located in the driver area outside of the area of the digital pixel cell.

In one embodiment of the disclosure, the current mirror device is located in the area of the digital pixel cell and the first switching device of the current driver is located in the driver area outside of the area of the digital pixel cell.

The disclosure provides a current driving digital pixel apparatus including a power rail, a common rail, a micro light emitting device, a current driver. The power rail is configured to supply a source current. The micro light emitting device is configured to be electrically coupled to the common rail. The current driver includes a first switching device configured to be electrically coupled to the power rail and a current mirror device configured to be electrically coupled between the first switching device and the micro light emitting device. The current mirror device is configured to receive the source current from the power rail through the first switching device and supply a current to the micro light emitting device. The current driving digital pixel apparatus further includes a second switching device electrically coupled to the micro light emitting device.

In one embodiment of the disclosure, the first switching device and the second switching device are turned on and off simultaneously.

In one embodiment of the disclosure, the micro light emitting device is located in an area of a digital pixel cell, and at least the first switching device of the current driver is located in a driver area outside of the area of the digital pixel cell.

In one embodiment of the disclosure, the second switching device is configured to turn off a discharging path for a parasitic capacitor located between the area of a digital pixel cell and the driver area when the first switching device is turned off.

In one embodiment of the disclosure, the first switching device and the current mirror device of the current driver are both located in the driver area outside of the area of the digital pixel cell.

In one embodiment of the disclosure, the current mirror device is located in the area of the digital pixel cell and the first switching device of the current driver is located in the driver area outside of the area of the digital pixel cell.

In one embodiment of the disclosure, the second switching device is electrically coupled between the current mirror device and the micro light emitting device.

In one embodiment of the disclosure, the second switching device is electrically coupled between the common rail and the micro light emitting device.

In one embodiment of the disclosure, the first switching device is a low voltage device and the current mirror device is a medium voltage device.

In one embodiment of the disclosure, the first switching device is a medium voltage device and the current mirror device is a low voltage device.

In one embodiment of the disclosure, the first switching device and the current mirror device are medium voltage devices.

In one embodiment of the disclosure, the first switching device and the current mirror device are low voltage devices.

In one embodiment of the disclosure, the second switching device is a medium voltage device.

Based on the above, in the disclosure, since the first switching device is electrically coupled between the power rail and the current mirror device, the first switching device can be a low voltage (LV) device which is controlled by a LV lever control signal. In addition, the current mirror device is a medium voltage (MV) device. Normally, the LV device has a lower threshold voltage, a lower turn-on resistance, and a smaller size compared to the MV device. Therefore, in the disclosure, the dynamic power required in turning on and turning off the first switching device, which is a LV device, is reduced. In addition, the coupling back noise from the first switching device, when switching (turning on and turning off), to the voltage signal controlling the current mirror device is also greatly reduced.

Moreover, one current driver has a larger size than one micro light emitting device. In the disclosure, since the current drivers are all located in the area outside of the area of the digital pixel cell, the current drivers can be flexibly designed to optimize performance without being restricted by area condition. Further, in the area of the digital pixel cell, the wiring area for the signal controlling the first switching device and the voltage signal controlling the current mirror device is not required, there is only one connection from the current drivers to the digital pixel cell, and there is no device under the digital pixel cell. Hence, it is possible to dispose/arrange more micro light emitting devices in the same area of the digital pixel cell, so as to achieve finer pitch micro light emitting device.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Figure 1:
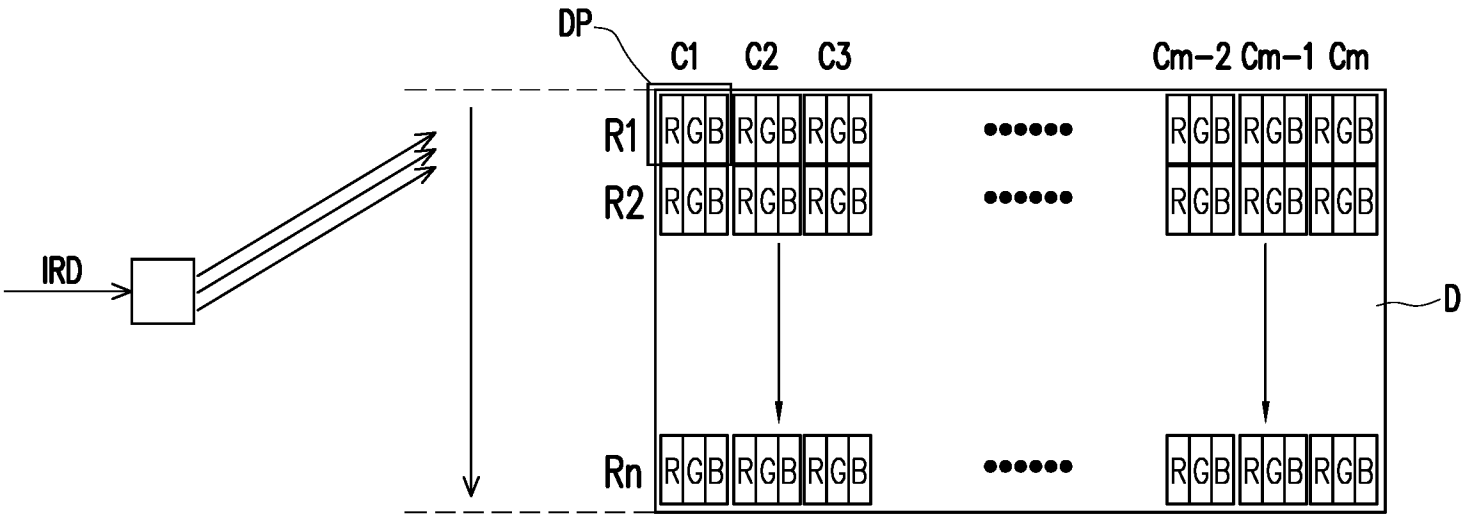
FIG. 1 is a schematic view showing a row scanning process in a display according to one embodiment of the disclosure.

FIG. 1 is a schematic view showing a row scanning process in a display according to one embodiment of the disclosure. As shown in FIG. 1, a display D has a screen formed of an array of digital pixels DP. To be more specific, the screen of the display D has m columns C1 to Cm and n rows R1 to Rn of digital pixels DP, and m and n are integers greater than or equal to 1. Each of the digital pixels DP is constituted of one blue micro-LED, one green micro-LED, and one red micro-LED and the corresponding current drivers. In addition, each of the blue micro-LED, the green micro-LED, and the red micro-LED functions as an light source when receiving data from a controller (not shown). In the display D, an input row data IRD is provided to a single row of the digital pixels DP or to a plurality of rows of the digital pixels DP at a time. When receiving the input row data IRD, the blue micro-LEDs, the green micro-LEDs, and the red micro-LEDs in the single row or the plurality of rows emit blue light, green light, and red light so as to function as the light source at that time. Next, the input row data IRD is provided to the next row or next rows in sequence from R1 to Rn or in direction of the arrows from the top to the bottom of the display D as shown in FIG. 1. In other words, the light source, which is a single row or a plurality of rows of the digital pixels DP, scan vertically between the row R1 and the row Rn, and the input row data IRD is continuously inputted to control the rows of digital pixels DP to display image. In this way, the full screen of m×n digital pixels DP resolution is realized.

Figure 2B:
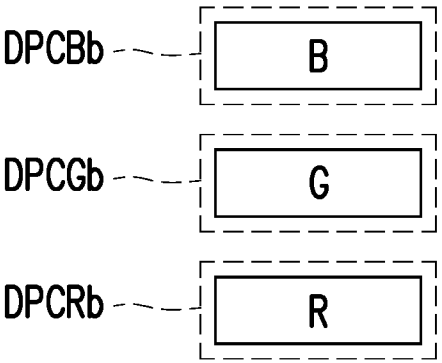
FIG. 2A and FIG. 2B are schematic views showing a digital pixel according to the embodiment in FIG. 1.
Figure 2A:
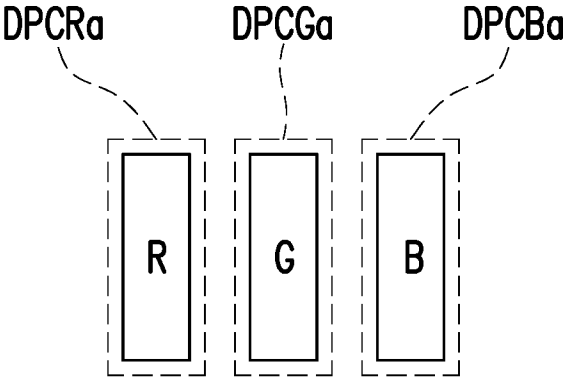

FIG. 2A and FIG. 2B are schematic views showing a digital pixel according to the embodiment in FIG. 1. As shown in FIG. 2A, a digital pixel DPa includes a red micro-LED R, a green micro-LED G, and a blue micro-LED B directly bonding on a silicon chip. To be more specific, each of the red micro-LED R, the green micro-LED G, and the blue micro-LED B is driven by one cell driver circuit (current driver) disposed below. The red micro-LED R and the corresponding cell driver circuit disposed under the red micro-LED R form a red digital pixel cell DPCRa. Similarly, the green micro-LED G and the corresponding cell driver circuit disposed under the green micro-LED G form a green digital pixel cell DPCGa, and the blue micro-LED B and the corresponding cell driver circuit disposed under the blue micro-LED B form a blue digital pixel cell DPCBa. In the present embodiment, the red digital pixel cell DPCRa, the green digital pixel cell DPCGa, and the blue digital pixel cell DPCBa are horizontally arranged, but the disclosure is not limited thereto.

A digital pixel DPb shown in FIG. 2B is similar to the digital pixel DPa shown in FIG. 2A. The difference is that a red digital pixel cell DPCRb, the green digital pixel cell DPCGb, and the blue digital pixel cell DPCBb are vertically arranged.

Figure 3:
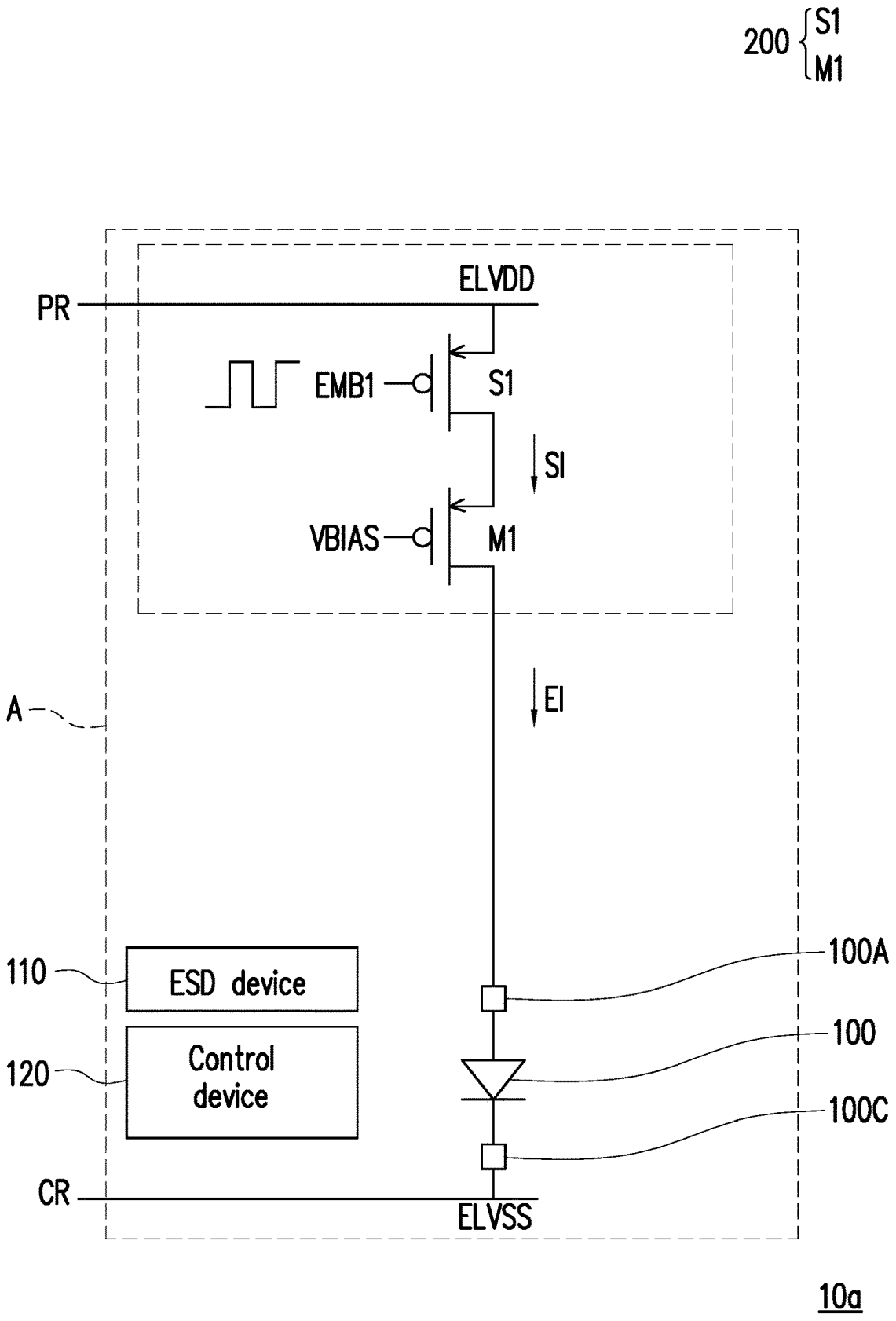
FIG. 3 is a schematic view showing a current driving digital pixel apparatus of a digital pixel cell according to one embodiment of the disclosure.

FIG. 3 is a schematic view showing a current driving digital pixel apparatus of a digital pixel cell according to one embodiment of the disclosure. As shown in FIG. 3, a current driving digital pixel apparatus 10*a* includes a power rail PR, a common rail CR, a micro light emitting device 100, and a current driver 200. The micro light emitting device 100 is electrically coupled to the common rail CR. The current driver 200 includes a first switching device S1 and a current mirror device M1. The first switching device S1 of the current driver 200 is electrically coupled to the power rail PR. The current mirror device M1 of the current driver 200 is electrically coupled between the first switching device S1 and the micro light emitting device 100. To be more specific, an anode 100A of the micro light emitting device 100 is electrically connected to the current mirror device M1, and a cathode 100C of the micro light emitting device 100 is electrically connected to the common rail CR. The micro light emitting device 100 and the current driver 200 are both located in the same area A of the digital pixel cell in the current driving digital pixel apparatus 10*a*.

The current driving digital pixel apparatus 10*a* further includes an electrostatic discharge device 110 and a control device 120. The electrostatic discharge device 110 is used to protect an internal circuit of the current driving digital pixel apparatus 10*a*. The control device 120 is used to control the internal circuit of the current driving digital pixel apparatus 10*a*. The electrostatic discharge device 110 and the control device 120 can be arranged/located in the same area A of the digital pixel cell in the current driving digital pixel apparatus 10*a*.

In addition, the power rail PR is configured to supply a source current SI to the current mirror device M1 through the first switching device S1, and the first switching device S1 is configured to turn on and turn off the source current SI received by the current mirror device M1. The current mirror device M1 receives the source current SI from the power rail PR through the first switching device S1 and supplies a current EI, which is an expected current, to the micro light emitting device 100.

When the micro light emitting device 100 is turned off or in a disable state, the voltage of the anode 100A of the micro light emitting device 100 is approximately equal to a voltage ELVSS of the common rail CR. Since the current mirror device M1 is directly and electrically connected to the anode 100A of the micro light emitting device 100, the current mirror device M1 should be a medium voltage (MV) device when concerning the stress of the current mirror device M1. In other words, the current mirror device M1 should be a medium voltage (MV) device to withstand the voltage stress from the anode 100A.

Since the first switching device S1 is electrically coupled between the power rail PR and the current mirror device M1, the first switching device S1 is near a voltage ELVDD of the power rail PR. Therefore, when the first switching device S1 is turned on (in enable state) or is turned off (in disable state), the drain, the source, the gate, and the buck of the first switching device S1 are not stressed because of overvoltage. Consequently, it is possible that the first switching device S1 is a low voltage (LV) device. It should be noted here, the first switching device S1 is configured to turn on and turn off the source current SI received by the current mirror device M1.

As a result, in the present embodiment, the first switching device S1 can be a LV device and the current mirror device M1 can be a MV device. In addition, the first switching device S1 is controlled to be turned on or turned off by the high and low levels of a signal EMB1, and the current mirror device M1 is controlled by a voltage signal VBIAS. Since the first switching device S1 is a LV device, it is possible that the signal EMB1 is a LV lever control signal, and the waveform of the signal EMB1 is shown in FIG. 3 as an example. It should be noted here, the signal EMB1 and the voltage signal VBIAS may be applied at the same time or at different times, the disclosure is not limited thereto.

Normally, the LV device has a lower threshold voltage Vt, a lower turn-on resistance, and a smaller size compared to the MV device. Therefore, in the present embodiment, the dynamic power required in turning on and turning off the first switching device S1, which is a LV device, can be reduced. In addition, the noise coupled back from the first switching device S1, when switching (turning on and turning off), to the voltage signal VBIAS, can be also greatly reduced.

In the present embodiment, the first switching device S1 is a switching transistor, and the current mirror device M1 is a current mirror transistor circuit. The micro light emitting device 100 may be a red, green, or blue micro-LED. However, the disclosure is not limited thereto.

Figure 4:
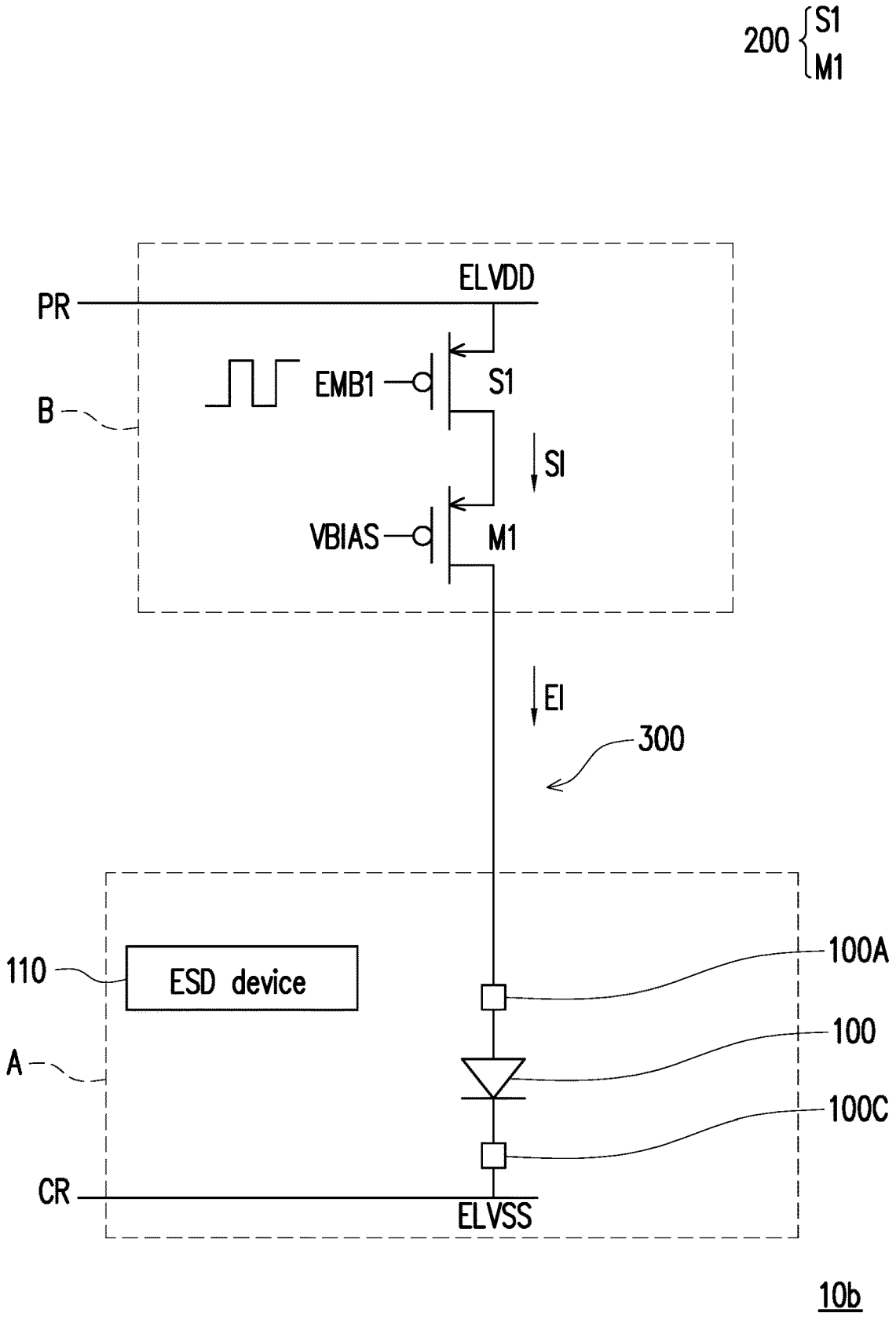
FIG. 4 is a schematic view showing a current driving digital pixel apparatus of a digital pixel cell according to another embodiment of the disclosure.
Figure 5:
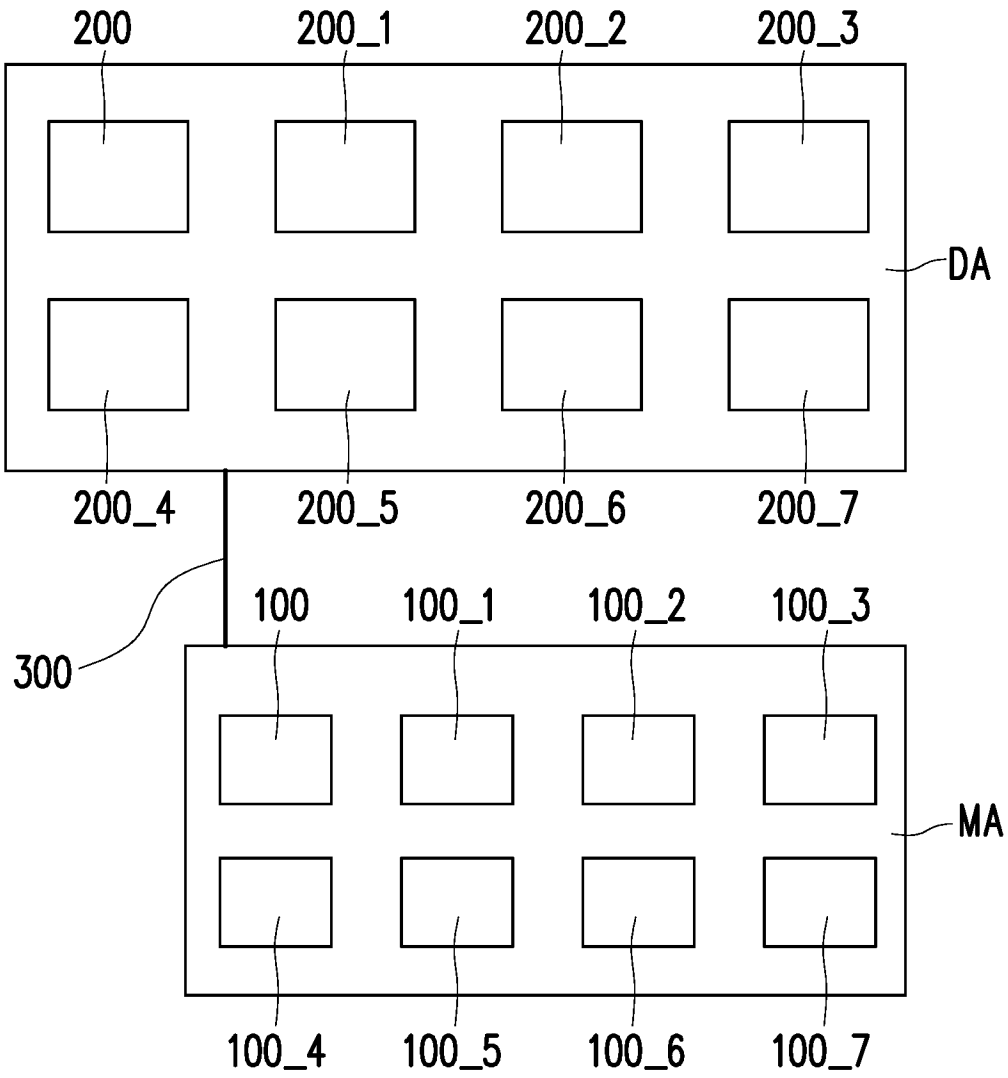
FIG. 5 is a schematic view showing an array driver and a micro light emitting device array according to the embodiment in FIG. 4.

FIG. 4 is a schematic view showing a current driving digital pixel apparatus of a digital pixel cell according to another embodiment of the disclosure. FIG. 5 is a schematic view showing an array driver and a micro light emitting device array according to the embodiment in FIG. 4. A current driving digital pixel apparatus 10*b* in the present embodiment is similar to the current driving digital pixel apparatus 10*a* in FIG. 3, so only the differences are described hereinafter. As shown in FIG. 4, in the current driving digital pixel apparatus 10*b* of the present embodiment, the micro light emitting device 100 and the electrostatic discharge device 110 are located in the area A of the digital pixel cell in the current driving digital pixel apparatus 10*b*. However, the current driver 200 is located in a driver area B outside of the area A of the digital pixel cell. The current driver 200 and the digital pixel cell area A can be connected with each other by only one connection 300. That is to say, the first switching device S1 and the current mirror device M1 of the current driver 200 are both located in the driver area B outside of the area A of the digital pixel cell, but the disclosure is not limited thereto. In other embodiments, the micro light emitting device 100 is located in the area A of the digital pixel cell, and at least the first switching device S1 of the current driver 200 is located in the driver area B outside of the area A of the digital pixel cell. The micro light emitting device 100 belongs to an active micro light emitting device array, and the current driver 200 belongs to a driver array. It should be noted here, the control device 120 is not located within the area A of the digital pixel cell in the current driving digital pixel apparatus 10*b*.

To be more specific, as shown in FIG. 5, the micro light emitting device 100 together with the micro light emitting devices 100_1 to 100_7 are arranged on an active micro light emitting device array MA. The current driver 200 together with the current drivers 200_1 to 200_7 are arranged on a driver array DA. The configuration and structure of each of the micro light emitting devices 100_1 to 100_7 is the same as the configuration and structure of the micro light emitting device 100. The configuration and structure of each of the current drivers 200_1 to 200_7 is the same as the current driver 200. The current driver 200 is configured to control the micro light emitting device 100 as mentioned in the embodiment in FIG. 3. In the same way, the current drivers 200_1 to 200_7 are configured to control the micro light emitting devices 100_1 to 100_7, respectively. However, the current driver 200 together with the current drivers 200_1 to 200_7 on the driver array DA the are connected to the micro light emitting device 100 together with the micro light emitting devices 100_1 to 100_7 on the active micro light emitting device array MA by only one connection 300. The connection 300 may include a plurality of conductive wires, and each conductive wire connect one current driver to one corresponding micro light emitting device, the disclosure is not limited thereto. In addition, there are eight current drivers and eight micro light emitting devices in the present embodiment as an example, the disclosure is not limited thereto. In other embodiments, there are more than one current driver and one micro light emitting device.

In general, one current driver has a larger size than one micro light emitting device. Since the current drivers 200 and 200_1 to 200_7 are all located in the driver area B outside of the area A of the digital pixel cell, the current drivers 200 and 200_1 to 200_7 can be flexibly designed to optimize performance without being restricted by area condition. Further, in the area A of the digital pixel cell, the wiring area for the signal EMB1 and the voltage signal VBIAS is not required, there is only one connection 300 to the digital pixel cell, and there is no device under the digital pixel cell (there is only one current driving connection to the anode 100A). Hence, it is possible to dispose/arrange more micro light emitting devices in the same area A of the digital pixel cell, so as to achieve finer pitch micro light emitting device.

Figure 6:
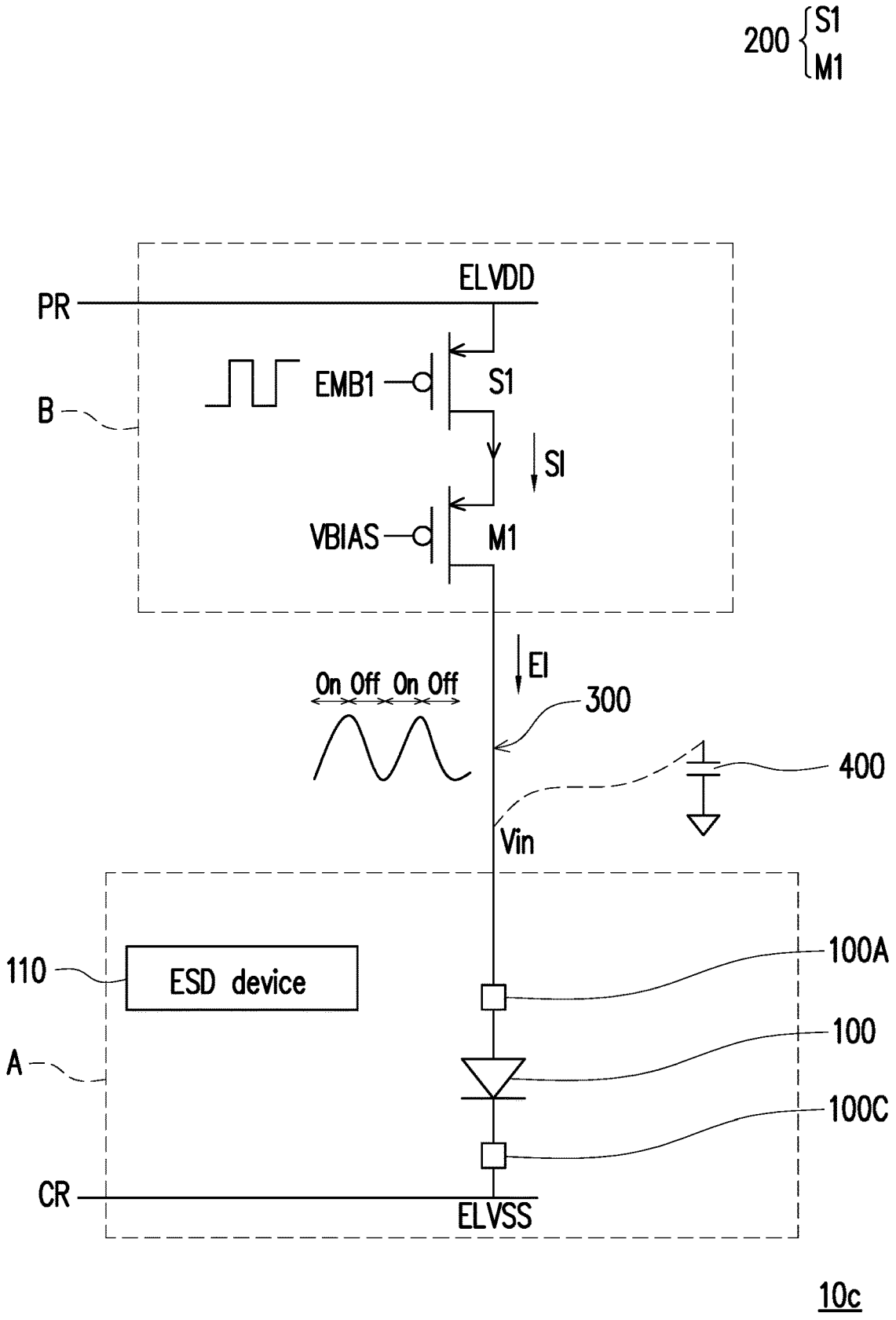
FIG. 6 is a schematic view showing a current driving digital pixel apparatus of a digital pixel cell according to yet another embodiment of the disclosure.

FIG. 6 is a schematic view showing a current driving digital pixel apparatus of a digital pixel cell according to yet another embodiment of the disclosure. A current driving digital pixel apparatus 10*c* in the present embodiment is similar to the current driving digital pixel apparatus 10*b* in FIG. 4, only the differences are described hereinafter. As shown in FIG. 6, a parasitic capacitor 400 exists in the current driving digital pixel apparatus 10*c*, electrically coupled to the anode 100A of the micro light emitting device 100.

It should be noted here, in the current driving digital pixel apparatus 10*b* of the embodiment shown in FIG. 4, the current driver 200 and the area A of the digital pixel cell have a long connection therebetween. In other words, the length of the connection 300 is long so the connection 300 is a long connection between the current driver 200 and the area A of the digital pixel cell. It causes an additional and large capacitor loading at the anode 100A of the micro light emitting device 100. To be more specific, when the micro light emitting device 100 is turned on, the current EI, which is a constant current, is supplied to the anode 100A of the micro light emitting device 100. At that time, the current EI charges the anode 100A to reach a voltage V_anode. When the micro light emitting device 100 is turned off and the current driver 200 stops supplying the current EI to the anode 100A of the micro light emitting device 100, the voltage V_anode at the anode 100A is discharged by the micro light emitting device 100.

Therefore, in the current driving digital pixel apparatus 10*b*, the smaller the current EI becomes, the longer time the process of turning on and turning off the micro light emitting device 100 is required. It may cause a problem to fast-scan-rate applications of the current driving digital pixel apparatus 10*b*. In addition, larger power consumption to charge and discharge the anode 100A of the micro light emitting device 100 is required.

Since the micro light emitting device 100 of the digital pixel cell is driven by a constant current source (the current EI is constant), the voltage V_anode reaches a DC level (mean value) when the first switching device S1 is turned on and the current EI is supplied. In the current driving digital pixel apparatus 10*c* of the present embodiment, the parasitic capacitor 400 is electrically coupled to the anode 100A of the micro light emitting device 100. In addition, the parasitic capacitor 400 is the largest and dominant capacitor at the same DC level. That is to say, the parasitic capacitor 400 provides a pseudo voltage at the anode 100A of the micro light emitting device 100 when the micro light emitting device 100 is turned on and turned off. In addition, there is no need for an additional current to charge or discharge the dominate capacitor 400. Consequently, there no need a long time to charge the anode 100A to reach the DC level, so the whole circuit (the current driving digital pixel apparatus 10*c*) has a higher speed and lower power consumption. The waveform of the voltage Vin in the on (turning on or charging) and off (turning off or discharging) process of the micro light emitting device 100 is shown in FIG. 6.

Figure 7:
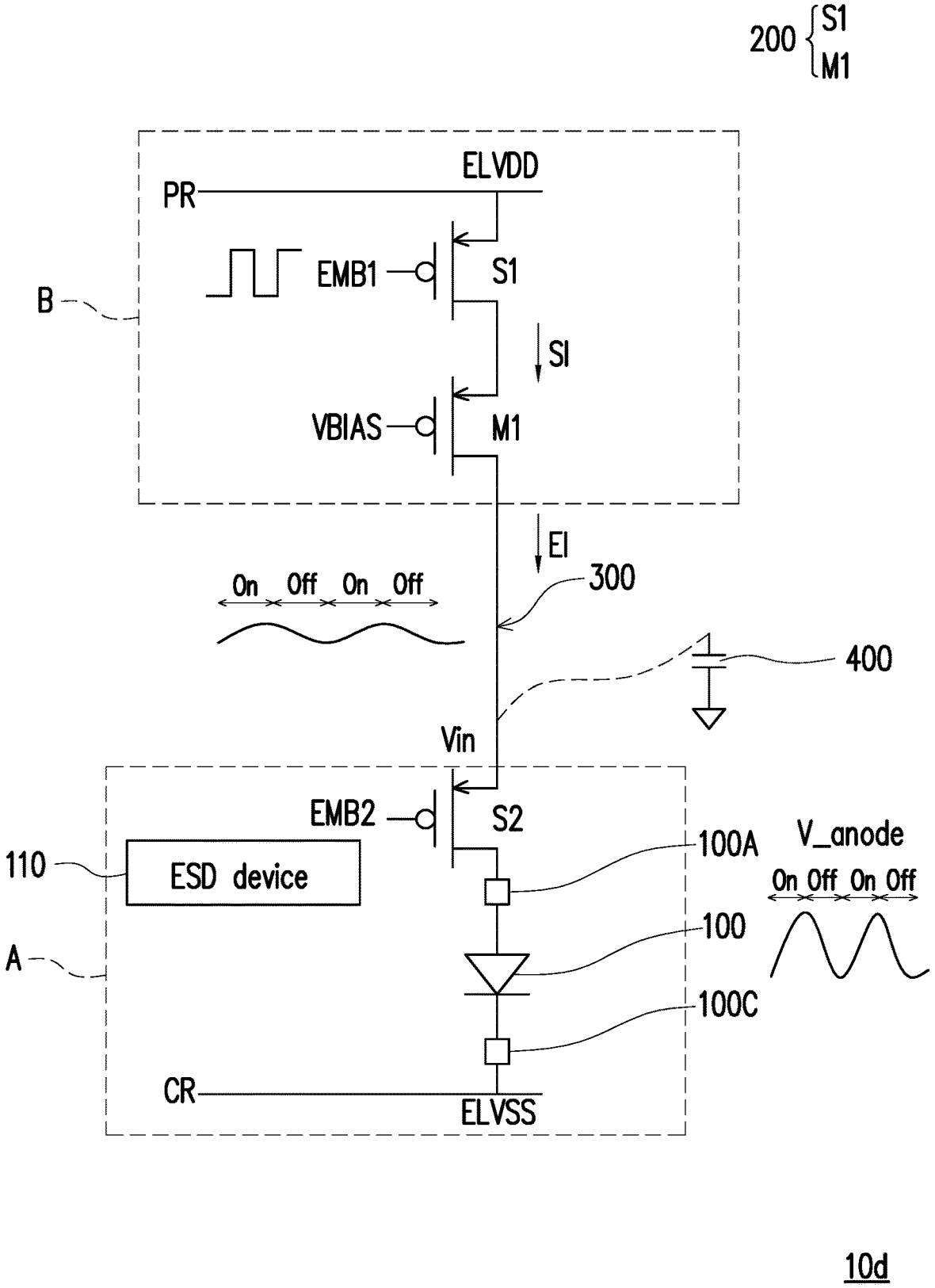
FIG. 7 is a schematic view showing a current driving digital pixel apparatus of a digital pixel cell according to yet another embodiment of the disclosure.

FIG. 7 is a schematic view showing a current driving digital pixel apparatus of a digital pixel cell according to yet another embodiment of the disclosure. A current driving digital pixel apparatus 10*d* in the present embodiment is similar to the current driving digital pixel apparatus 10*c* in FIG. 6, so only the differences are described hereinafter. As shown in FIG. 7, the current driving digital pixel apparatus 10*d* further includes a second switching device S2 that is electrically coupled to the micro light emitting device 100. To be more specific, the second switching device S2 is electrically coupled between the anode 100A of the micro light emitting device 100 and the parasitic capacitor 400. The second switching device S2 is also electrically coupled between the anode 100A of the micro light emitting device 100 and the current mirror device M1 of the current driver 200. In addition, the second switching device S2 can be controlled to be turned on or turned off by the high and low levels of a signal EMB2.

In the disclosure, the micro light emitting device 100 is located in the area A of the digital pixel cell, and at least the first switching device S1 of the current driver 200 is located in the driver area B outside of the area A of the digital pixel cell. To be more specific, the first switching device S1 and the current mirror device M1 of the current driver 200 are both located in the driver area B outside of the area A of the digital pixel cell in the present embodiment.

In the present embodiment, the second switching device S2 can be used to separate the parasitic capacitor 400 and the digital pixel cell. Preferably but not limitedly, the first switching device S1 and the second switching device S2 can be controlled to be turned on or turned off by the signal EMB1 and the signal EMB2 at the same time. In other words, the first switching device S1 and the second switching device S2 can be turned on and off simultaneously. As such, the parasitic capacitor 400 can provide a pseudo voltage and keeps the pseudo voltage at the same voltage level when the micro light emitting device 100 is turned on and turned off. Therefore, shorter time and less power are required when switching the micro light emitting device 100 on and off. To be more specific, when the micro light emitting device 100 is turned on, the current EI directly drives the micro light emitting device 100 with the assist of the pseudo voltage provided by the parasitic capacitor 400. Hence, the micro light emitting device 100 can be turned on faster. When the micro light emitting device 100 is turned off, the second switching device S2 is turned off and separates the parasitic capacitor 400 and the anode 100A of the micro light emitting device 100. In other words, the second switching device S2 separates the pseudo voltage and the voltage of the anode 100A of the micro light emitting device 100. Therefore, only the voltage of the anode 100A is discharged by the micro light emitting device 100, causing the micro light emitting device 100 to be turned off faster. Moreover, the second switching device S2 is configured to turn off a discharging path for the parasitic capacitor 400 located between the area A of the digital pixel cell and the driver area B when the first switching device S1 is turned off. Furthermore, the waveform of voltage V_anode at the anode 100A in the on (turning on or charging) and off (turning off or discharging) process is also shown in FIG. 7, and the waveform of the voltage Vin using in the on (turning on or charging) and off (turning off or discharging) process of the micro light emitting device 100 is also shown in FIG. 7.

In the present embodiment, it is possible that the first switching device S1 is a LV device, and the current mirror device M1 is a MV device, but the disclosure is not limited thereto. Since there is presence of the second switching device S2, the first switching device S1 may be a MV device and the current mirror device M1 may be a LV device, the first switching device S1 and the current mirror device M1 are both MV devices, or the first switching device S1 and the current mirror device M1 can be both LV devices. It should be noted here, the second switching device S2 can be a MV device.

Figure 8:
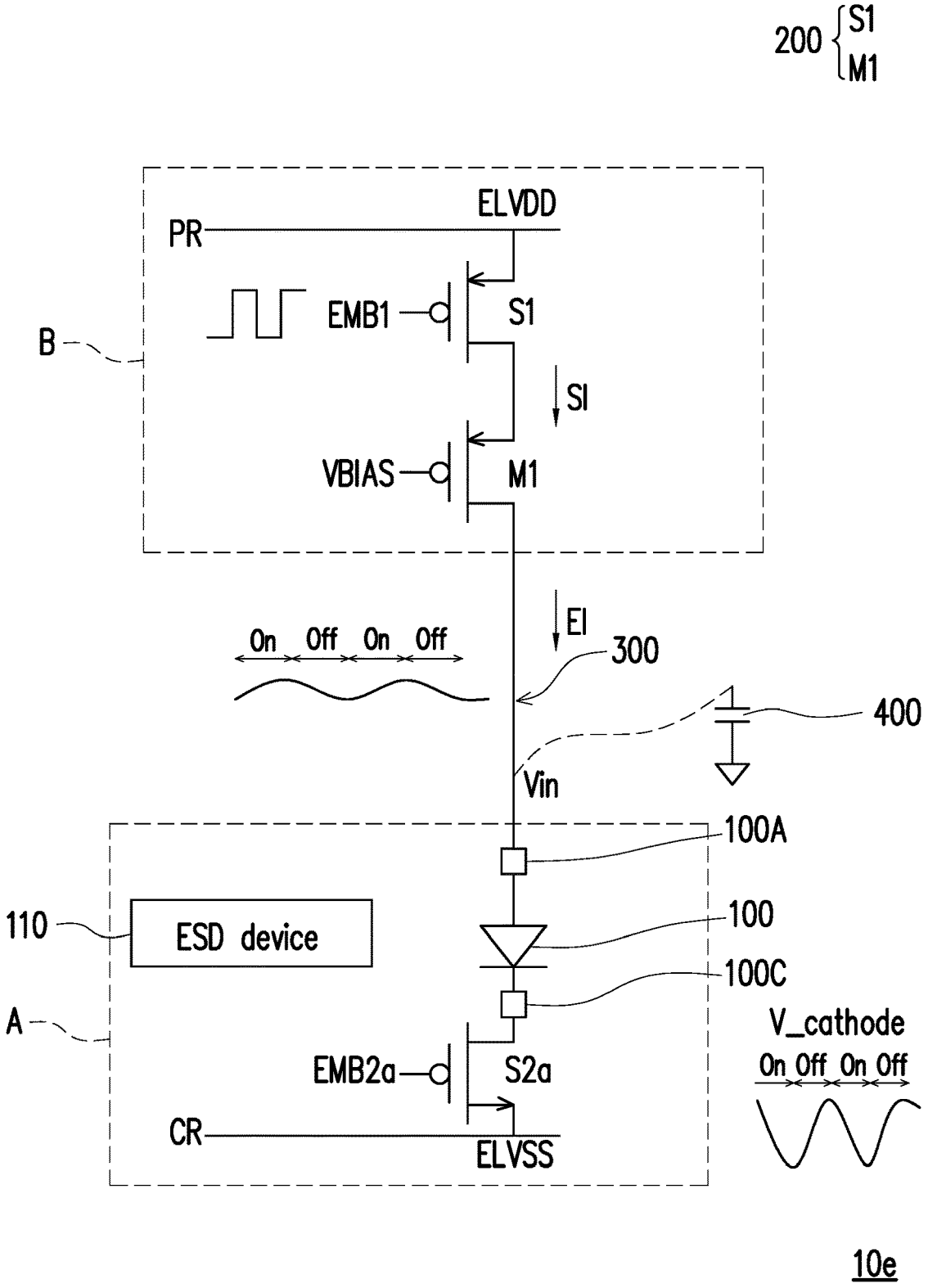
FIG. 8 is a schematic view showing a current driving digital pixel apparatus of a digital pixel cell according to yet another embodiment of the disclosure.

FIG. 8 is a schematic view showing a current driving digital pixel apparatus of a digital pixel cell according to yet another embodiment of the disclosure. A current driving digital pixel apparatus 10*e* in the present embodiment is similar to the current driving digital pixel apparatus 10*d* in FIG. 7, only the differences are described hereinafter. As shown in FIG. 8, the current driving digital pixel apparatus 10*e* further includes a second switching device S2*a* instead of the second switching device S2 in FIG. 7. The second switching device S2*a* is electrically coupled between the cathode 100C of the micro light emitting device 100 and the common rail CR. The second switching device S2*a* is controlled to be turned on or turned off by the high and low levels of a signal EMB2*a*. Preferably but not limitedly, the first switching device S1 and the second switching device S2*a* are controlled to be turned on or turned off by the signal EMB1 and the signal EMB2*a* at the same time. In other words, the first switching device S1 and the second switching device S2*a* are turned on and off simultaneously.

In the present embodiment, the second switching device S2*a* is used to separate the cathode 100C of the micro light emitting device 100 and the common rail CR. The parasitic capacitor 400 provides a pseudo voltage and keeps the pseudo voltage at the same voltage level when the micro light emitting device 100 is turned on and turned off. Therefore, shorter time and less power are required when switching the micro light emitting device 100 on and off. To be more specific, when the micro light emitting device 100 is turned on, the current EI directly drives the micro light emitting device 100 with the assist of the pseudo voltage provided by the parasitic capacitor 400. Hence, the micro light emitting device 100 is turned on faster. When the micro light emitting device 100 is turned off, the second switching device S2*a* is turned off and separates the cathode 100C of the micro light emitting device 100 and the common rail CR. In other words, the second switching device S2*a* separates the voltage of the cathode 100C of the micro light emitting device 100 and the voltage ELVSS of the common rail CR. Therefore, only the voltage of the cathode 100C is discharged by the micro light emitting device 100, so the micro light emitting device 100 is turned off faster. Further, the waveform of voltage V_cathode at the cathode 100C in the "on" (turning on or charging) and "off" (turning off or discharging) process is shown in FIG. 8, and the waveform of the voltage Vin using in the "on" (turning on or charging) and "off" (turning off or discharging) process of the micro light emitting device 100 is also shown in FIG. 8.

Figure 9:
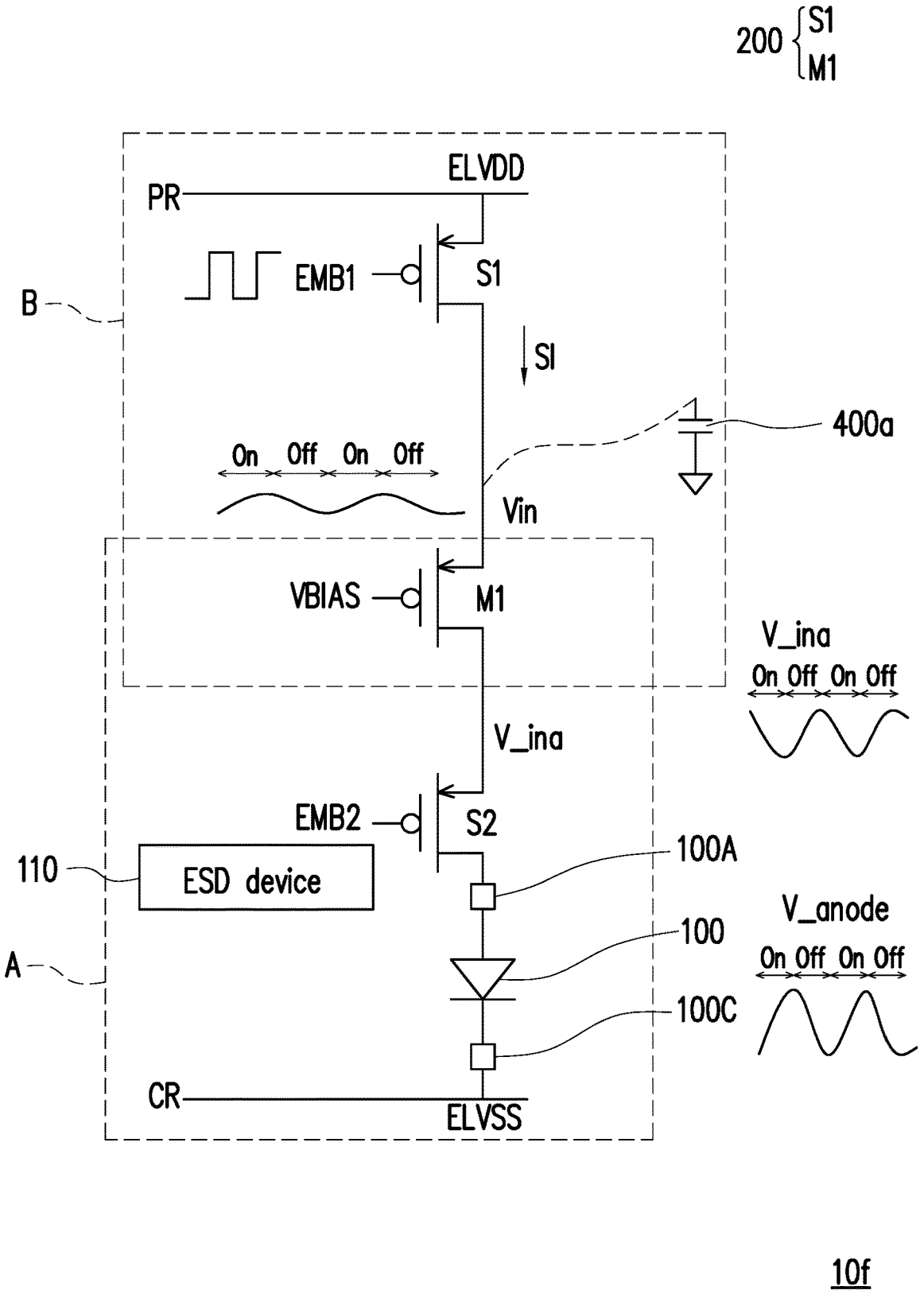
FIG. 9 is a schematic view showing a current driving digital pixel apparatus of a digital pixel cell according to yet another embodiment of the disclosure.

FIG. 9 is a schematic view showing a current driving digital pixel apparatus of a digital pixel cell according to yet another embodiment of the disclosure. A current driving digital pixel apparatus 10*f* in the present embodiment is similar to the current driving digital pixel apparatus 10*c* in FIG. 6, only the differences are described hereinafter. In the current driving digital pixel apparatus 10*f* of the present embodiment, the area A of the digital pixel and the driver area B are overlapped. The current mirror device M1 is located at the overlapped region of the area A and the driver area B. That is to say, the micro light emitting device 100 and the current mirror device M1 of the current driver 200 are located in the area A of the digital pixel cell, and the first switching device S1 of the current driver S1 is located outside of the area A of the digital pixel cell. In other words, the current mirror device M1 is located in the area A of the digital pixel cell and the first switching device S1 of the current driver 200 is located in the driver area B outside of the area A of the digital pixel cell.

The current driving digital pixel apparatus 10*f* further includes a capacitor 400*a*. The parasitic capacitor 400*a* is coupled to the ground and between the first switching device S1 and the current mirror device M1. In addition, the current driving digital pixel apparatus 10*f* further includes a second switching device S2 that is electrically coupled to the micro light emitting device 100. The second switching device S2 is electrically coupled between the current mirror device M1 and the anode 100A of the micro light emitting device 100. In addition, the second switching device S2 is controlled to be turned on or turned off by the high and low levels of a signal EMB2. Preferably but not limitedly, the first switching device S1 and the second switching device S2 are controlled to be turned on or turned off by the signal EMB1 and the signal EMB2 at the same time. In other words, the first switching device S1 and the second switching device S2 are turned on and off simultaneously.

In the present embodiment, the second switching device S2 is used to separate the parasitic capacitor 400*a* and the digital pixel cell. The parasitic capacitor 400*a* provides a pseudo voltage and keeps the pseudo voltage at the same voltage level when the micro light emitting device 100 is turned on and turned off. Therefore, shorter time and less power are required when the micro light emitting device 100 is switched on and off. To be more specific, when the micro light emitting device 100 is turned on, the current EI directly drives the micro light emitting device 100 with the assist of the pseudo voltage provided by the parasitic capacitor 400*a*. Hence, the micro light emitting device 100 is turned on faster. When the micro light emitting device 100 is turned off, the second switching device S2 is turned off and separates the parasitic capacitor 400*a* and the anode 100A of the micro light emitting device 100. In other words, the second switching device S2 separates the pseudo voltage and the voltage of the anode 100A of the micro light emitting device 100. Therefore, only the voltage of the anode 100A is discharged by the micro light emitting device 100, so the micro light emitting device 100 is turned off faster.

Further, a voltage V_ina is a voltage at the position between the current mirror device M1 and the second switching device S2. The waveform of the voltage V_ina in the "on" (turning on or charging) and "off" (turning off or discharging) process is shown in FIG. 9. Additionally, the waveform of the voltage Vin using in the on and off process of the micro light emitting device 100 is also shown in FIG.

9, and the waveform of voltage V_anode at the anode 100A in the on (turning on or charging) and off (turning off or discharging) process is also shown in FIG. 9.

Figure 10:
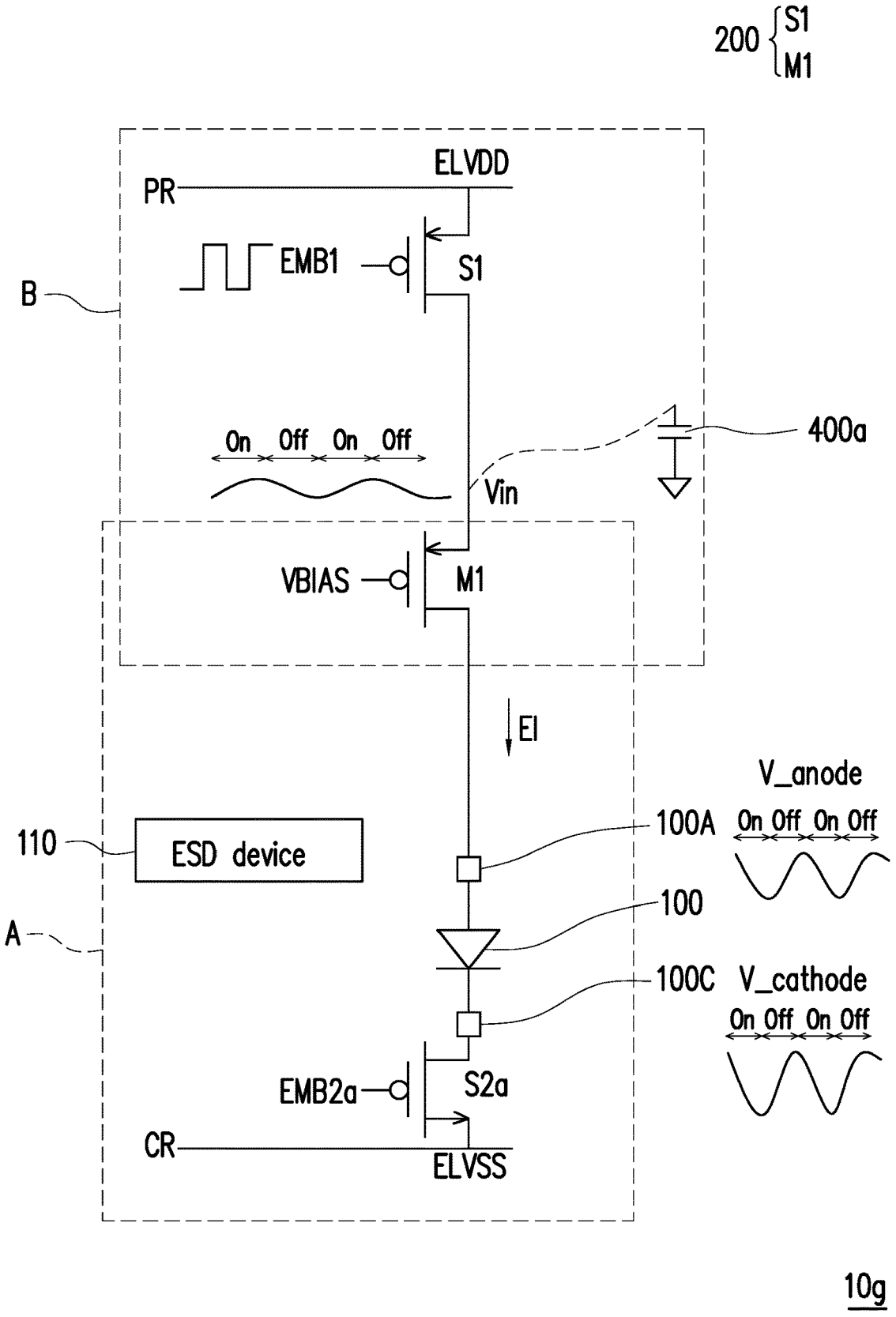
FIG. 10 is a schematic view showing a current driving digital pixel apparatus of a digital pixel cell according to yet another embodiment of the disclosure.

FIG. 10 is a schematic view showing a current driving digital pixel apparatus of a digital pixel cell according to yet another embodiment of the disclosure. A current driving digital pixel apparatus 10*g* in the present embodiment is similar to the current driving digital pixel apparatus 10*f* in FIG. 9, so only the differences are described hereinafter. The current driving digital pixel apparatus 10*g* of the present embodiment further includes the second switching device S2*a*, the second switching device S2*a* is electrically coupled between the common rail CR and the cathode 100C of the micro light emitting device 100.

In the present embodiment, the second switching device S2*a* is used to separate the cathode 100C of the micro light emitting device 100 and the common rail CR. The parasitic capacitor 400*a* provides a pseudo voltage and keeps the pseudo voltage at the same voltage level when the micro light emitting device 100 is turned on and turned off. Therefore, shorter time and less power are required when switching the micro light emitting device 100 on and off. To be more specific, when the micro light emitting device 100 is turned on, the current EI directly drives the micro light emitting device 100 with the assistance of the pseudo voltage provided by the parasitic capacitor 400*a*. Hence, the micro light emitting device 100 is turned on faster. When the micro light emitting device 100 is turned off, the second switching device S2*a* is turned off and separates the cathode 100C of the micro light emitting device 100 and the common rail CR. In other words, the second switching device S2*a* separates the voltage of the cathode 100C of the micro light emitting device 100 and the voltage ELVSS of the common rail CR. Therefore, only the voltage of the cathode 100C is discharged by the micro light emitting device 100, causing the micro light emitting device 100 to be turned off faster.

In FIG. 10, the waveform of the voltage Vin using in the on (turning on or charging) and off (turning off or discharging) process of the micro light emitting device 100 is also shown. Further, the waveform of the voltage V_anode at the anode 100A and the waveform of the voltage V_cathode at the cathode 100C in the "on" (turning on or charging) and "off" (turning off or discharging) process are also shown in FIG. 10.

In summary, in the disclosure, since the first switching device is electrically coupled between the power rail and the current mirror device, the first switching device can be a low voltage (LV) device which is controlled by a LV lever control signal. In addition, the current mirror device can be a medium voltage (MV) device. Normally, the LV device has a lower threshold voltage, a lower turn-on resistance, and a smaller size compared to the MV device. Therefore, in the disclosure, the dynamic power required in turning on and turning off the first switching device, which is a LV device, can be reduced. In addition, the noise coupled back from the first switching device, during the switching (turning on and turning off) time, to the voltage signal controlling the current mirror device, can be also greatly reduced.

Moreover, one current driver has a larger size than one micro light emitting device. In the disclosure, since the current drivers are all located in the area outside of the area of the digital pixel cell, the current drivers can be flexibly designed to optimize performance without being restricted by area condition. Further, in the area of the digital pixel cell, the wiring area for the signal controlling the first switching device and the voltage signal controlling the current mirror device is not required, there is only one connection from the current drivers to the digital pixel cell, and there is no device under the digital pixel cell. Hence, it is possible to dispose/arrange more micro light emitting devices in the same area of the digital pixel cell, so as to achieve finer-pitch micro light emitting device.

In addition, a second switching device, a capacitor, or both the second switching device and the parasitic capacitor are added to reduce the discharging or charging time. Therefore, shorter time and less power are required when the micro light emitting device is switched on and off.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A current driving digital pixel apparatus, comprising:
- a power rail, configured to supply a source current;
- a common rail;
- a micro light emitting device, configured to be electrically coupled to the common rail;
- a current driver, comprising:
  - a first switching device, configured to be electrically coupled to the power rail; and
  - a current mirror device, configured to be electrically coupled between the first switching device and the micro light emitting device, the current mirror device configured to receive the source current from the power rail through the first switching device and supply a current to the micro light emitting device; and
- a second switching device, electrically coupled to the micro light emitting device,
- wherein the micro light emitting device is located in an area of a digital pixel cell, and at least the first switching device of the current driver is located in a driver area outside of the area of the digital pixel cell, and wherein to reduce the parasitic capacitors to speed up the charge and discharge speed, the second switching device is configured to turn off a discharging path for a parasitic capacitor located between the area of the digital pixel cell and the driver area when the first switching device is turned off.

2. The current driving digital pixel apparatus as recited in claim 1, wherein the first switching device and the second switching device are turned on and off simultaneously.

3. The current driving digital pixel apparatus as recited in claim 1, wherein the first switching device and the current mirror device of the current driver are both located in the driver area outside of the area of the digital pixel cell.

4. The current driving digital pixel apparatus as recited in claim 1, wherein the current mirror device is located in the area of the digital pixel cell and the first switching device of the current driver is located in the driver area outside of the area of the digital pixel cell.

5. The current driving digital pixel apparatus as recited in claim 1, wherein the second switching device is electrically coupled between the current mirror device and the micro light emitting device.

6. The current driving digital pixel apparatus as recited in claim 1, wherein the second switching device is electrically coupled between the common rail and the micro light emitting device.

7. The current driving digital pixel apparatus as recited in claim 1, wherein the first switching device is a low voltage device and the current mirror device is a medium voltage device.

8. The current driving digital pixel apparatus as recited in claim 1, wherein the first switching device is a medium voltage device and the current mirror device is a low voltage device.

9. The current driving digital pixel apparatus as recited in claim 1, wherein the first switching device and the current mirror device are medium voltage devices.

10. The current driving digital pixel apparatus as recited in claim 1, wherein the first switching device and the current mirror device are low voltage devices.

11. The current driving digital pixel apparatus as recited in claim 1, wherein the second switching device is a medium voltage device.

12. The current driving digital pixel apparatus as recited in claim 1, wherein the first switching device is a switching transistor, and the current mirror device is a current mirror transistor circuit.

13. The current driving digital pixel apparatus as recited in claim 1, wherein the first switching device is configured to turn on and turn off the source current received by the current mirror device.

14. The current driving digital pixel apparatus as recited in claim 1, wherein the micro light emitting device is a red, green, or blue micro light emitting diode.

15. The current driving digital pixel apparatus as recited in claim 1, wherein an anode of the micro light emitting device is electrically connected to the current mirror device, and a cathode of the micro light emitting device is electrically connected to the common rail.

* * * * *